United States Patent [19]

Temmesfeld et al.

[11] Patent Number: 4,763,724

[45] Date of Patent: Aug. 16, 1988

[54] PLASTIC RADIATOR FOR TRANSVERSE-FLOW COOLING SYSTEMS OF INTERNAL COMBUSTION ENGINES

[75] Inventors: Axel Temmesfeld, Bad Feilnbach; Karl Tauber, Munich, both of Fed. Rep. of Germany

[73] Assignee: Bayerische Motoren Werke Aktiengesellschaft, Munich, Fed. Rep. of Germany

[21] Appl. No.: 46,878

[22] PCT Filed: Dec. 4, 1985

[86] PCT No.: PCT/EP85/00665

§ 371 Date: Apr. 17, 1987

§ 102(e) Date: Apr. 17, 1987

[87] PCT Pub. No.: WO86/03554

PCT Pub. Date: Jun. 19, 1986

[30] Foreign Application Priority Data

Dec. 5, 1984 [DE] Fed. Rep. of Germany ..... 3444273

[51] Int. Cl.[4] ..... F01P 11/02

[52] U.S. Cl. ..... 165/71; 123/41.14; 123/41.54; 165/104.32

[58] Field of Search ..... 165/71, 104.32; 123/41.14, 41.54, 41.51

[56] References Cited

U.S. PATENT DOCUMENTS

| | | | |
|---|---|---|---|
| 4,449,692 | 5/1984 | Rhodes | 165/71 |
| 4,457,362 | 7/1984 | Cadars | 165/104.32 |
| 4,492,267 | 1/1985 | Cadars | 165/104.32 |
| 4,592,418 | 6/1986 | Cadars | 165/104.32 |

FOREIGN PATENT DOCUMENTS

| | | |
|---|---|---|
| 2044033 | 4/1978 | Fed. Rep. of Germany . |
| 3330710 | 3/1984 | Fed. Rep. of Germany . |
| 3341390 | 5/1984 | Fed. Rep. of Germany . |

*Primary Examiner*—Albert W. Davis, Jr.
*Attorney, Agent, or Firm*—Barnes & Thornburg

[57] ABSTRACT

A transverse-flow radiator for internal combustion engines, which is equipped with a plastic water chamber and a balancing chamber joined to this water chamber and wherein by an air venting line from leading from a high point of the water chamber via a liquid lock molded onto the balancing chamber, and wherein a vertical main part of the venting line has a lower molded-out opening which controls a discharge valve with discharge connections that can be mutually connected or closed off which lead to the water chamber, the balancing chamber and a discharge opening.

20 Claims, 4 Drawing Sheets

1
2
3
4
5
6
7
8
8'
8"
9
10
11
12
13
14
14'
15
16
16'
17
18
19
20
20
21
22
23
24
25
26
27
28
29

1
2
3
4
5
6
7
8
8'
8"
10'
14
15
15'
16
17'
18
19
19'
20'
21
22
23
24
25
26
27
28

PLASTIC RADIATOR FOR TRANSVERSE-FLOW COOLING SYSTEMS OF INTERNAL COMBUSTION ENGINES

BACKGROUND AND SUMMARY OF THE INVENTION

The invention relates to a water chamber that is made of plastic for a transverse-flow radiator for internal-combustion engines of a construction having a molded-on balancing chamber with a filler neck and filling lid containing pressure control valves, wherein a venting line connects a high point of the water chamber with a water inlet and a lower-disposed junction of the venting line connects into the balancing chamber and wherein there is a connection molded on in the bottom area of the balancing chamber for an ancillary-flow return line that is separate from a radiator return flow return line that leads to the suction side of a coolant pump.

In the case of a known chamber of this construction according to DE-A No. 33 30 710, the air venting line, when the junction into the balancing chamber is located at a lower point, requires a separate element, and its fastening requires additional manufacturing expenditures. The separate emptying of the water chamber and of the balancing chamber also requires considerable servicing expenditures for the separating of both line connections, or possibly additional construction expenditures for a discharge stopper.

In the case of a known radiator of a similar construction according to DE-A No. 33 41 390, the air venting line connects the balancing chamber with a high point of the radiator in the water chamber that is located opposite the junction of the forward flow line from the engine into the radiator. The balancing chamber, in its bottom area in the direction of the water chamber that is integral with it, has an open connection to its area from which the return flow line from the radiator to the engine leads out of the water tank. This development is not very suitable for a cooling circuit for liquid-cooled internal-combustion engines having a return-flow mixing thermostat because in that case, the ancillary venting flow remains inoperative until the cooling circuit opens, and the ancillary venting flow, by the inclusion of the radiator, prolongs the warm-up time of the engine. From DE-A No. 20 44 033, a radiator of a similar construction is also known in which an air venting line, from a high point of the radiator for a low-situated U-loop serving as a hydraulic lock is connected with a high point of the balancing chamber, and at the lowest point of the venting line, a connection is arranged to a joint discharge valve for the venting line, for the balancing chamber and via a connecting opening, to the chamber for the water chamber. This text contains no suggestions with respect to a development as plastic parts that meets the requirements of manufacturing.

It is the objective of the invention to further develop a water chamber made of plastic for a transverse-flow radiator of an internal combustion engine having a molded-on balancing chamber with a filler neck and filling lid containing pressure control valves, wherein a venting line connects a high point of the water chamber with a water inlet and a lower-disposed junction of the venting line connects into the balancing chamber and wherein there is a connection molded on in the bottom area of the balancing chamber for an ancillary-flow return line that is separate from a radiator return flow return line that leads to the suction side of a coolant pump. In such a system and with low manufacturing costs, the combination with a return-flow mixing thermostat is made possible without any functional disadvantages. In that case, the warm-up time must be short, the integral molding-out of the different radiator elements must be made easier, and a simple emptying of the cooling circuit must be possible. In order to achieve this objective, the invention provides for a water chamber made of plastic and having as a result, for a short warm-up period, the ancillary venting flow in the water tank, over a short path, leading from the forward flow line into the venting line; the venting line is molded directly onto the water chamber and the balancing chamber during their molding at low manufacturing expenditures; and the lower molded-out opening of the venting line houses a discharge valve that permits a simple simultaneous emptying of the radiator and the venting chamber as well as of the venting line itself.

An additional advantage occurs by the advantageous molding-out of the junction of the venting line into the balancing chamber at a parting plane between two portions of the balancing chamber is achieved so that special sealing measures for the molded-out openings are not necessary.

A further advantage arises in that a control line that connects to the venting line and leads to the pressure control valves in the filling lid is integrally molded onto the water or balancing chamber, without additional construction expenditures for separate parts. During the filling, while the mouth of the control line is open, the control line acts as an additional venting opening and, as a result, accelerates filling, when the junction of the venting line into the chamber has a throttled cross-section.

A still further advantage is obtained by an arrangement of the venting and/or control lines which are molded by webs onto either or both of the water and balancing chambers and which is particularly advantageous for plastic molding and avoids accumulations of material.

A still further advantage occurs when the web separates the water chamber and the balancing chamber.

A still further advantage occurs in molding-out of the venting and/or control lines as well as the integral molding of the filler neck onto the chamber and the development of the upper part of the balancing chamber being made transparent or translucent at least in the area of normal coolant level for the monitoring of the coolant level without impairing the development of the water chamber made of opaque material with high firmness and thus thin wall thickness and low weight. In this case, the independent possibility to construct the cross-section of the upper part of the balancing chamber to be approximately circular and thus secure with respect to deformation aids the use of a transparent or translucent plastic with low firmness, but still with a thin wall thickness and low weight.

The arrangement of the junction of the air venting line into the balancing chamber on both sides of a parting partition between an upper and lower portion thereof aids the molding-out of this junction by means of a mold slide that is arranged in a preform for the balancing chamber close to the parting plane and can be moved transversely to the molding-out direction.

Having the connection of the control line to the venting line in the lower part of the balancing chamber as well as laterally offset to the main part of the control line and with the control line in parallel to the venting line in the area of the upper part of the chamber aids in the molding process.

A further advantage resides in an arrangement of the balancing chamber with respect to the water chamber with a vent and control line connected to the water compartment by webs is compact with respect to space and has the venting and control lines extending between them in a protected way.

These and other objects, features, and advantages of the present invention will become more apparent from the following description when taken in connection with the accompanying drawings which show, for the purposes of illustration only, plural embodiments in accordance with the present invention, and wherein:

DETAILED DESCRIPTION OF THE DRAWINGS

Figure 1:
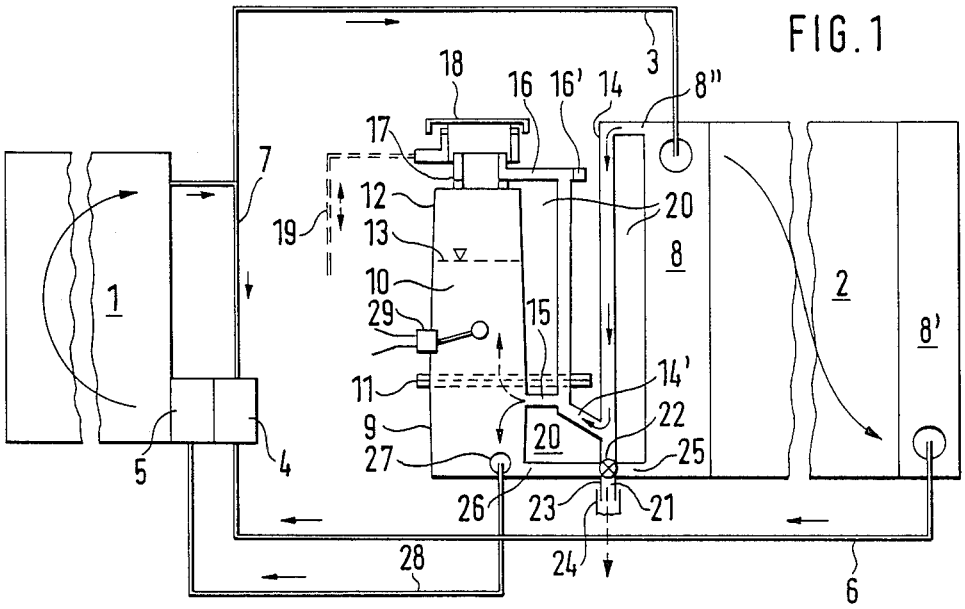
FIG. 1 is a diagrammatic view of a cooling circuit for a liquid-cooled internal-combustion engine having a transverse-flow radiator according to the invention.

Referring now to the drawings wherein like reference numerals are used to designate like parts and more particularly to FIG. 1, a liquid-cooled internal-combustion engine 1 is connected with a transverse-flow radiator 2 directly by means of a forward-flow line 3, and via a thermostat 4 and a coolant pump 5, by means of a return-flow line 6. A bypass line 7 connects the forward-flow line 3 directly with the thermostat 4. The radiator 2 has one respective plastic forward-flow and return-flow water chamber 8 and 9. According to FIGS. 1 and 3 to 8, a lower part 9 of a storage, air venting and balancing chamber 10 is integrally molded onto the forward-flow water chamber 8. In the area of a parting plane 11, an upper part 12 of the balancing chamber 10 is fastened at the lower part 9 and thus at the water chamber 8. While the water chamber 8 with the lower part 9 of the balancing chamber 10 consists of an opaque, fiber-reinforced plastic material, the upper part 12 of the balancing chamber, because of its compression-proof approximately circular cross-section, may consist of a transparent plastic material so that the coolant level 13 in the balancing chamber can always be observed from the outside. The water chamber 8 and the chamber 10 are connected with an air venting line 14 that leads out of a high point 8'' of the water chamber 8 and ends in a junction 15 into the lower portion 9 of the balancing chamber 10. The junction 15 has a throttled cross-section and is selectively molded out starting from the water chamber 8 via a molded-out opening 15' that is closed off in the direction of the water chamber 8 and is located in the parting plane 11, between the two chamber parts 9 and 12 of the balancing chamber 10 that are, for example, connected with one another by means of gluing or welding. A control in 16 connects the air venting line 14, by means of the filler neck 17 of the balancing chamber 10, into a control space of the filling lid 18. The latter, in a conventional way, has pressure control valves that, via a discharge line 19, control a connection to the outside air when predetermined maximum and minimum pressure values in the water tank 8 or in the balancing chamber 10 are exceeded. The air venting line 14 and the lower portion of the control line 16, via webs 20, are integrally molded onto the water chamber 8 as well as the lower part 9 of the balancing chamber with the webs 20 also abuttingly connecting the upper portion of control line 16 with the upper part 12 of the balancing chamber 10. In this case, the webs 20, at a distance from the walls of the water chamber 8 and of the balancing chamber 10 for the lines are thickened in a tube-molded way. As a result, accumulations of material are avoided that could have a negative influence on the molding-out of the plastic parts.

The air venting line 14, in downward direction, continues to a molded-out and discharge opening 21 that contains a multiway discharge valve 22 and onto which a discharge connection piece 23 is molded for the connection of a discharge hose 24. One discharge connection 25, 26 from water chamber 8 and from the balancing chamber 10, respectively, leads into the discharge valve 22. These discharge connections 25 and 26 are either molded out continuously in the direction of the water chamber 8 in its moulding out direction or separately in the direction of the water chamber 8 or the balancing chamber 10. At the lower part 9 of the chamber 10, at a molded-on hose connection piece 27, a filling and ancillary-flow return-flow line 28 connects to the coolant pump 5. In the upper part 12 of the balancing chamber 10, an electric float switch 29 is installed that indicates an excessive lowering of the coolant level 13 via control light.

The air venting line 14, in the area of the parting plane 11 between the lower part 9 and the upper part 12 of the balancing chamber 10, contains a connecting part 14' to which, the control line 16 connects in a laterally off set way. A horizontal end section of the upper portion of the control line 16 that leads into the filler neck 17 is molded out by means of an external opening 16' that is closed by a plug.

Figure 3:
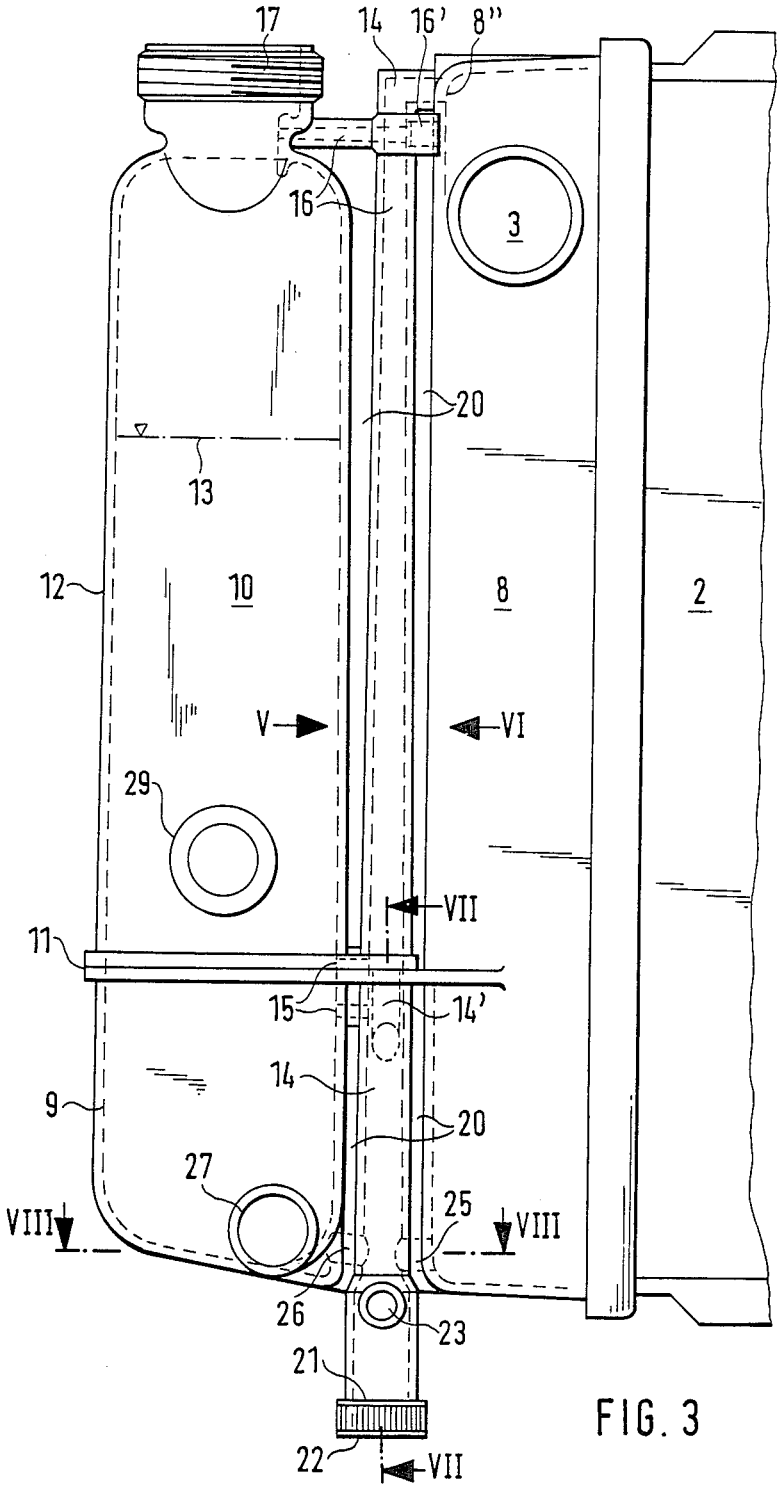
FIG. 3 is a partial lateral view of the water chamber with the storage, air venting and balancing chamber leading to the transverse-flow radiator according to FIG. 1.
Figure 4:
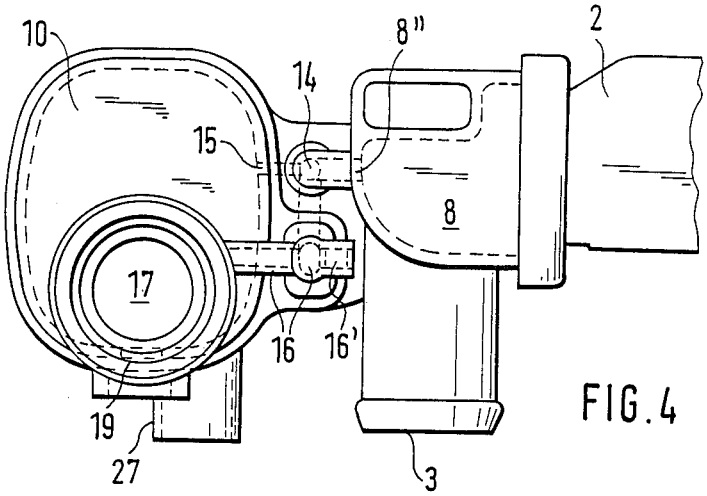
FIG. 4 is a top view of FIG. 3.
Figure 7:
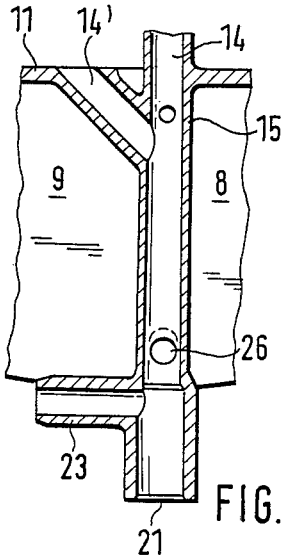
FIG. 7 is a partial view according to the Line VII—VII in FIG. 3.
Figure 8:
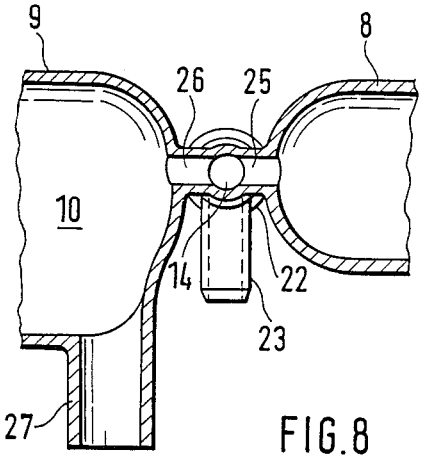
FIG. 8 is a partial view according to the Line VIII—VIII in FIG. 3.
Figure 5:
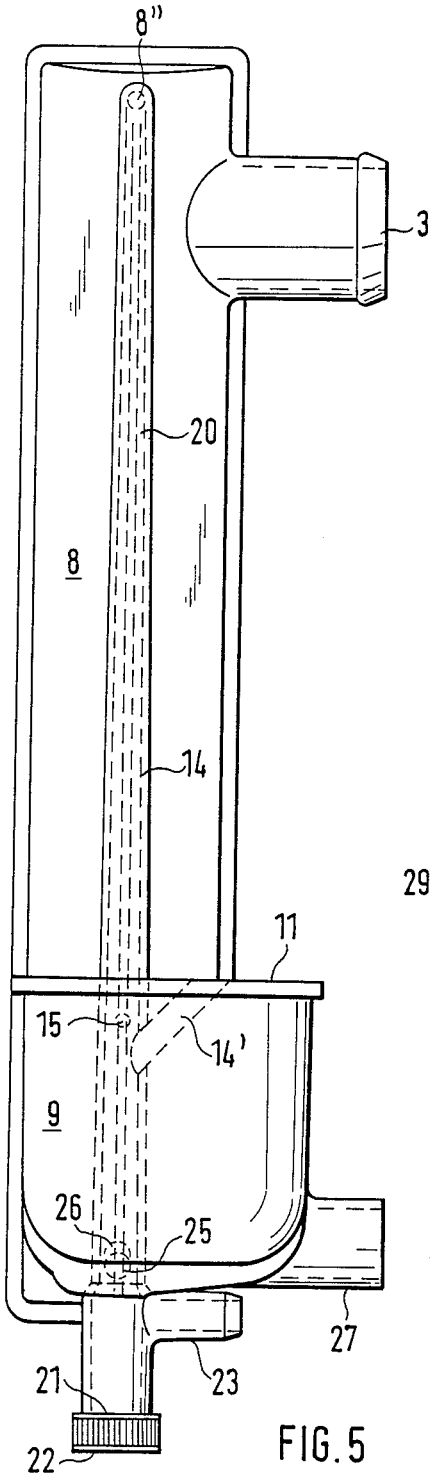
FIG. 5 is another lateral view according to the Arrow V in FIG. 3 without the upper part of the chamber.
Figure 6:
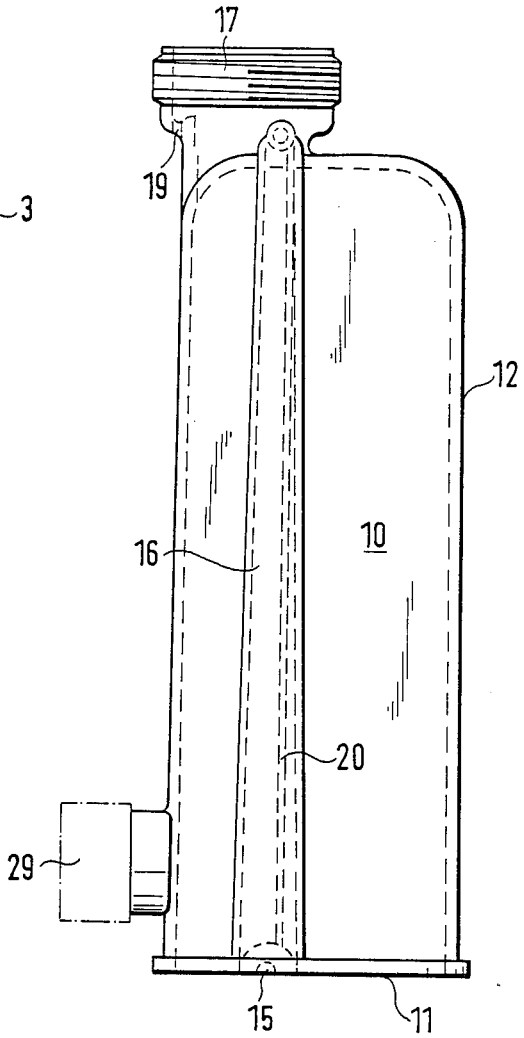
FIG. 6 is a view of the upper part of the chamber in the direction of the Arrow VI in FIG. 3.

As shown particularly in FIGS. 3 and 4, the air venting line 14 and the control line 16 are arranged in a protected and space-saving way, at a narrow distance between the water chamber 8 and the balancing chamber 10. Instead of long thin mold slides, they can be developed by means of molded-in metal pipes without draft in a way that is advantageous with respect to manufacturing.

Figure 2:
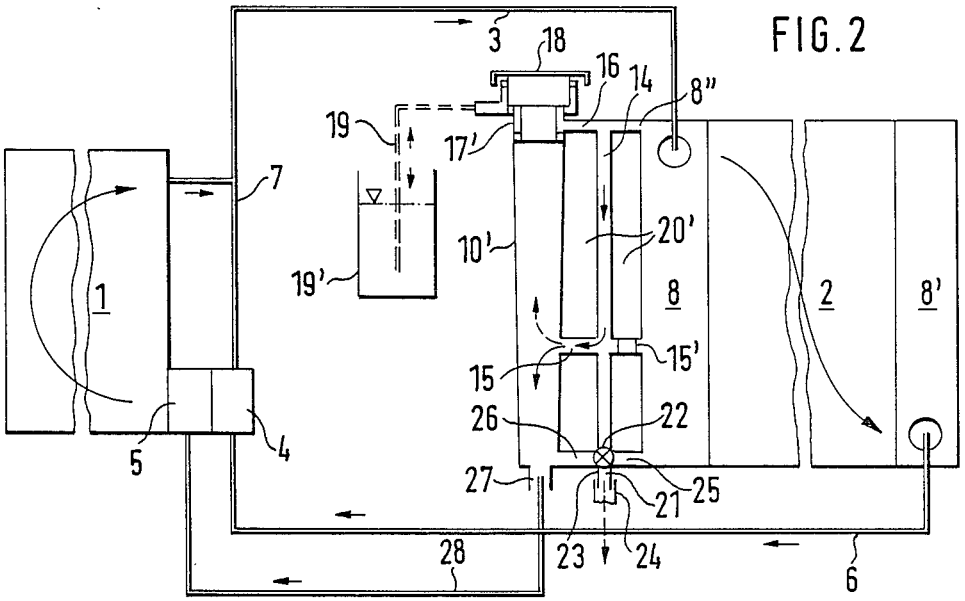
FIG. 2 is a partial sectional view of the representation according to FIG. 1 with a modified development of the air venting chamber that is molded onto a water chamber of the transverse-flow radiator.

The development according to FIG. 2 contains a balancing chamber 10' that is molded integrally onto the water chamber 8, said balancing chamber 10' being developed with a smaller volume and so that it can be molded out in the direction of the filler neck 17'. For the coolant storage, an atmospheric storage tank 19' is connected to the discharge line 19, said storage tank 19', at the same time, acting as a hydraulic seal for the complete venting of the cooling circuit including the chamber 10'.

In the case of this development, the control in 16 branches away from the venting line 14 directly in the area of the high point 8'' of the water chamber 8. The junction 15 of the control line 14 into the balancing chamber 10' branches away directly from the main part of the venting line 14 and in the direction of the water chamber 8, is molded out via a molded-out opening 15' that is closed by a plug. The water chamber 8 and the balancing chamber 10' are integrally connected by means of webs 20' that, approximately in the center between the water chamber and the chamber in a pipe-shaped thickening, contains the venting line 14.

Both developments of a transverse-flow radiator according to the invention, on the basis of the characteristics according to the claims, permit a rational manufacturing with a few plastic parts that can be molded out advantageously, while ensuring an advantageous cooling system operation with respect to filling, emptying and forward-flow excess pressure control, particularly in the case of a separate return-flow connection of a balancing chamber arranged at a forward-flow water chamber.

While we have shown and described only plural embodiments in accordance with the present invention, it is understood that the same is not limited thereto but is susceptible to numerous changes and modifications as known to one having ordinary skill in the art, and therefore do not wish to be limited to the details shown and described herein, but intend to cover all such modifications as are encompassed by the scope of the appended claims.

We claim:

1. A plastic water chamber means of a transverse-flow radiator for internal combustion engines, having a molded-on balancing chamber means (10) with a filler neck (17) and a filling lid means (18) containing pressure control valves, comprising: a venting line means (14) connects a high point (8'') of the water chamber means (8) and a lower-disposed junction means (15) into the balancing chamber means (10); a connection means (27), molded to a bottom area of the balancing chamber (10) for an ancillary-flow return line means (28) that is separate from a radiator return flow line means (6) and which separate return line means leads to the suction side of a coolant pump (5); the venting line means being (14) molded integrally to the water chamber means and extending to a lower molded-out discharge opening means (21) into which are located molded-on discharge connections (25 and 26) respectively leading from the water chamber means (8) and from the balancing chamber means (10); and wherein the molded-out and discharge opening means (21) contains a discharge valve means (22) that connects the venting line means (14) and the discharge connections (25 and 26) and a discharge outlet with one another in an open position of the discharge valve means or seals them off with respect to one another in a closed position of the discharge valve means.

2. A water chamber means according to claim 1, wherein the junction means (15) of the venting line means (14) into the balancing chamber (10) is molded out by means of a mold slide in a parting plan (11) between two balancing chamber parts (9 and 12).

3. A water chamber means according to claim 1, wherein the venting line means (14) is integrally molded onto the water chamber (8) and is connected via a control line means (16) with a junction into the filler neck (17) that is connected to a control space of the filling lid means (18).

4. A water chamber means according to claim 1, wherein at least one of venting line (14) and the control line means (16) are arranged essentially in webs means (20) that are molded externally onto at least one of the water chamber means (8) and the balancing chamber means (10) and wherein said web means are thickened in a pipe-shaped way at a distance from said water chamber and balancing chamber means.

5. A water chamber means according to claim 4, wherein the water chamber means (8) and the balancing chamber means (10) are integrally connected by the web means at a distance from the water chamber means and the balancing chamber means.

6. A water chamber means according to claim 1, wherein the balancing chamber means (10) has a lower part (9) that is integrally molded onto the water chamber means (8) and has an upper part (12) that is fastened to the lower part.

7. A water chamber means according to claim 6, wherein the upper part (12) consists of a plastic material that is transparent or translucent at least in an area of a coolant level (13).

8. A water chamber means according to claim 6, wherein the lower disposed junction means (15) is arranged in an area on both sides of a parting plane (11) between the upper and the lower parts (9 and 12) of the balancing chamber means (10).

9. A water chamber means according to claim 1, wherein in an area below a parting plane (11) between an upper and a lower part (9 and 12) of the balancing chamber means (10), a connecting part means (14') of the venting line means (14) is molded out and laterally offset with respect to a main part of the venting line means (14) for connecting the control line means (16) that connects with the filling lid means and is molded onto the upper part (12) of the balancing chamber means with the venting line means.

10. A water chamber means according to claim 9, wherein parts of the venting line and control line means (14 and 16) that are vertically above the parting plane (11) are molded to the water chamber means (8) on the one side and on the other side are arranged at a free distance between the water chamber means (8) and the balancing chamber means (10), and are abuttingly connected thereto by plural web means (20) that are arranged approximately in parallel to one another and overlapping one another.

11. A water chamber means according to claim 2, wherein at least one of venting line (14) and the control line means (16) are arranged essentially in webs means (20) that are molded externally onto at least one of the water chamber means (8) and the balancing chamber means (10) and wherein said web means are thickened in a pipe-shaped way at a distance from said water chamber and balancing chamber means.

12. A water chamber means according to claim 11, wherein the water chamber means (8) and the balancing chamber means (10) are integrally connected by the web means at a distance from the water chamber means and the balancing chamber means.

13. A water chamber means according to claim 12, wherein the balancing chamber means (10) has a lower part (9) that is integrally molded onto the water chamber means (8) and has an upper part (12) that is fastened to the lower part.

14. A water chamber means according to claim 13, wherein the upper part (12) consists of a plastic material that is transparent or translucent at least in an area of a coolant level (13).

15. A water chamber means according to claim 13, wherein the lower disposed junction means (15) is arranged in an area on both sides of a parting plane (11) between the upper and the lower parts (9 and 12) of the balancing chamber means (10).

16. A water chamber means according to claim 3, wherein at least one of venting line (14) and the control line means (16) are arranged essentially in webs means (20) that are molded externally onto at least one of the water chamber means (8) and the balancing chamber means (10) and wherein said web means are thickened in a pipe-shaped way at a distance from said water chamber and balancing chamber means.

17. A water chamber means according to claim 16, wherein the water chamber means (8) and the balancing chamber means (10) are integrally connected by the web means at a distance from the water chamber means and the balancing chamber means.

18. A water chamber means according to claim 17, wherein the balancing chamber means (10) has a lower part (9) that is integrally molded onto the water chamber means (8) and has an upper part (12) that is fastened to the lower part.

19. A water chamber means according to claim 18, wherein the upper part (12) consists of a plastic material that is transparent or translucent at least in an area of a coolant level (13).

20. A water chamber means according to claim 18, wherein the lower disposed junction means (15) is arranged in an area on both sides of a parting plane (11) between the upper and the lower parts (9 and 12) of the balancing chamber means (10).

* * * * *